US006140599A

United States Patent [19]

Haas

[11] Patent Number: 6,140,599

[45] **Date of Patent: *Oct. 31, 2000**

[54] CONTACT CONFIGURATION FOR VACUUM SWITCHES

[75] Inventor: Wilfried Haas, Erlangen, Germany

[73] Assignee: Siemens Aktiengesellschaft, Munich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/217,859

[22] Filed: Dec. 21, 1998

Related U.S. Application Data

[63] Continuation of application No. PCT/DE97/01221, Jun. 16, 1997.

[30] Foreign Application Priority Data

Jun. 21, 1996 [DE] Germany ..... 196 24 920

[51] Int. Cl.[7] ..... H01H 33/66

[52] U.S. Cl. ..... 218/123; 218/128

[58] Field of Search ..... 218/123, 124, 218/125, 127, 128

[56] References Cited

U.S. PATENT DOCUMENTS 4,324,960 4/1982 Aoki et al. .
4,999,463 3/1991 Yin .
5,103,069 4/1992 Yorita .
5,763,848 6/1998 Hakamata et al. ..... 218/118

FOREIGN PATENT DOCUMENTS 195 09 714 A1 9/1996 Germany .

OTHER PUBLICATIONS

Japanese Patent Abstract No. 64–19610 (Noda), dated Aug. 10, 1990.

*Primary Examiner*—Lincoln Donovan
*Attorney, Agent, or Firm*—Herbert L. Lerner; Laurence A. Greenberg; Werner H. Stemer

[57] ABSTRACT

A contact configuration for vacuum switches includes two mutually opposite switch parts having a predetermined radius $R_K$. Each switch part has slots which proceed from a center and which extend outward to form a spiral contact. The contours of the slots have a variable radius with a foot which coincides with the center of the switch part. Preferably, the slots end at a recess which has a predetermined radius $R_I$ and lies at the center of the switch part or they slightly overlap the recess, where $R_I \approx 0.25–0.33 \cdot R_K$. Specific mathematical functions can be specified for the slot contours.

22 Claims, 4 Drawing Sheets

CONTACT CONFIGURATION FOR VACUUM SWITCHES

CROSS-REFERENCE TO RELATED APPLICATION

This application is a continuation of copending International Application No. PCT/DE97/01221, filed on Jun. 16, 1997, which designated the United States.

BACKGROUND OF THE INVENTION

FIELD OF THE INVENTION

The invention relates to a contact configuration for vacuum switches, including two mutually opposite switch parts or contact pieces having a circular base surface with a predetermined radius and a central circular recess, each switch part or contact piece having three to six slots proceeding from a center and extending outward, so that a spiral contact is formed, and the contours of the slots having a variable radius.

Vacuum switches have become increasingly used during recent times. Besides the medium voltage range, applications are also being proposed in the high voltage and low voltage range. In the case of the latter range, the contact configurations in the vacuum switching tubes are mainly constructed in such a way that a radial magnetic field to influence an arc is created.

A contracted metal vapor arc which is created in the case of short-circuit interruptions in vacuum switching tubes with radial magnetic field contacts should move away as fast as possible from its place of creation in the central region of the contacts. Local thermal overloads of the contact surfaces are avoided in that way. A large thermal stress due to a fast continuous running of the arc in the marginal zones of the switch parts or contact pieces should be prevented in the further temporal progression of the interruption as well. Moreover, the outwardly directed plasma stream from the arc should be as small as possible in order to keep the screen loading small.

In the case of spiral contacts, such an arc behavior is achieved, for example, by the application of slots in the switch parts. Through the use of the structure of those slots, it is possible to compel such a direction of the current flow in the contacts that the magnetic field caused thereby or the Lorentz force associated therewith influences the arc in its movement behavior and plasma escape behavior in an appropriate manner.

In the case of known spiral contacts which are used in commercial vacuum switching tubes, difficulties occur either in the course of the free running of the arc or in the course of the subsequent circulation in the contact marginal zones, as well as in the course of the transition between the two movement phases. Moreover, the commutation of the arc across the slots may be made more difficult if the magnitude of the driving magnetic force is indeed large but the azimuthal component moving the arc is too small and the radial component driving the plasma stream onto the screen is too large. In the case of those examples, either the slots extend in a rectilinear manner or their contour is distinguished by a constant radius of curvature.

U.S. Pat. No. 4,999,463 contains a mathematical description of a slot contour which possesses a variable radius, the foot of which does not coincide with the center of the switch part. As a result thereof, the slot can extend as far as the recess of the contacts, and in that way persistence of the arc in the course of free running can be avoided. In that case, however, the radial and azimuthal components of the Lorentz force acting on the arc at the outer end of the spiral wing seem to be so large and so small respectively that on one hand its commutation is made more difficult, and on the other hand the thermal screen loading becomes excessively large. Moreover, the free running of the arc is made more difficult by the small angle of intersection which exist between the slot contour and the periphery of the recess.

SUMMARY OF THE INVENTION

It is accordingly an object of the invention to provide a contact configuration for vacuum switches, which overcomes the hereinafore-mentioned disadvantages of the heretofore-known devices of this general type and which further improves the efficiency of spiral contacts.

With the foregoing and other objects in view there is provided, in accordance with the invention, a contact configuration for vacuum switches, comprising two mutually opposite switch parts or contact pieces each having a circular base surface with a center, a predetermined radius $R_K$ and a central circular recess; each of the switch parts or contact pieces having three to six individual slots proceeding from the center and extending outward, forming a spiral contact; the slots having contours with a variable radius, the radius having a foot coinciding with the center of the switch part or contact, the slots having a length in radian measure between $5/12$ and $2/3\ \pi$, and each of the individual slots forming an angle $\phi>\pi/3$ with the recess.

In accordance with another feature of the invention, the slots end at the recess which lies at the center of the switch part or contact piece and has a predetermined radius $R_I$ or they slightly overlap the recess, where $R_I \approx 0.25-0.33\ R_K$.

In accordance with a further feature of the invention, the slots end in front of the recess in a circular bore.

In accordance with an added feature of the invention, $R_I \leqq r(\psi) \leqq R_K$, where $r(\psi)$ is the radius of the slot contours, $R_K$ is the predetermined radius of the switch parts or contact pieces and $R_1$ is a predetermined radius of the recess.

In accordance with an additional feature of the invention, the slot contour is described by the following relation:

$$r(\psi)=R_I+(R_K-R_I)$$

$$r(\varphi) = R_I + (R_K - R_I) * \left[\frac{\mathrm{Cosh}(a_1 \cdot \varphi) - 1}{\mathrm{Cosh}(a_1 \cdot \psi) - 1}\right]^{f_1}$$

where $0.01<a_1<2$ and $0.15<f_1<0.6$.

In accordance with yet another feature of the invention, $a_1=1$ and $f_1=0.30$.

In accordance with yet a further feature of the invention, the slot contour is described by the following relation:

$$r(\psi)=R_I+(R_K-R_I)$$

$$r(\varphi) = R_I + (R_K - R_I) * \left[\frac{\mathrm{Sinh}(a_2 \cdot \varphi)}{\mathrm{Sinh}(a_2 \cdot \psi)}\right]^{f_2}$$

where $0.01<a_2<1.5$ and $0.25<f_2<1$.

In accordance with yet an added feature of the invention, $a_2=1$ and $f_2=0.50$.

In accordance with yet an additional feature of the invention, the slot contour is described by the following relation:

$$r(\psi)=R_I+(R_K-R_1)$$

$$r(\varphi) = R_I + (R_K - R_I) * \left[\frac{1 - \cos(a_3 \cdot \varphi)}{1 - \cos(a_3 \cdot \psi)}\right]^{f_3}$$

where $1.01<a_3<1.75$ and $0.19<f_3<0.76$

In accordance with again another feature of the invention, $a_3=1$ and $f_3=0.38$.

In accordance with again a further feature of the invention, the slot contour is described by the following relation:

$$r(\psi)=R_1+(R_K-R_I)*$$

$$r(\varphi) = R_I + (R_K - R_I) * \left[\frac{\sin(a_4 \cdot \varphi)}{\sin(a_4 \cdot \psi)}\right]^{f_4}$$

and $0.01<a_4<0.88$ and $0/37<f_4<1.5$.

In accordance with again an added feature of the invention, $a_4=0.5$ and $f_4=0.75$ In accordance with again an additional feature of the invention, the slot contour is described by the following relation:

$$r(\psi)=R_1+(R_K-R_I)*$$

$$r(\varphi) = R_I + (R_K - R_I) * \left[\frac{\varphi}{\psi}\right]^{f_5}$$

where $0.34<f_5<1.35$.

In accordance with still another feature of the invention, $f_5=0.67$.

In accordance with still a further feature of the invention, there are provided linear combinations and/or series expansions of the relations.

In accordance with still an added feature of the invention, the slot contour is described by the following relation:

$$r(\varphi) = R_I + (R_K - R_I) \cdot \left[\gamma_1 \frac{\mathrm{Cosh}(a_1\varphi) - 1}{\mathrm{Cosh}(a_1\psi) - 1} + \gamma_2 \frac{\mathrm{Sinh}(a_2\varphi)}{\mathrm{Sinh}(a_2\psi)} + \gamma_3 \frac{1 - \cos(a_3\varphi)}{1 - \cos(a_3\psi)} + \left(\gamma_4 \frac{\sin(a_4\varphi)}{\sin(a_4\psi)} + \gamma_5\left(\frac{\varphi}{\psi}\right)\right)\right]^f$$

*where*

$$\sum_v \gamma_v = 1$$

and $0.01<a<1$ as well as $0.2<f<0.75$.

In accordance with still an additional feature of the invention, the slots have a diameter D and a width b smaller than 1/10 of the diameter D.

In accordance with a concomitant feature of the invention, $0.04D \leqq b \leqq 0.1\ D$.

With the invention, switch parts or contact pieces having three to six and preferably four slots, are constructed in such a way that the magnetic force acting on the arc has an optimal behavior, both in the central as well as in the peripheral contact regions. In this way, a considerable improvement is accomplished as compared with the prior art.

Other features which are considered as characteristic for the invention are set forth in the appended claims.

Although the invention is illustrated and described herein as embodied in a contact configuration for vacuum switches, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
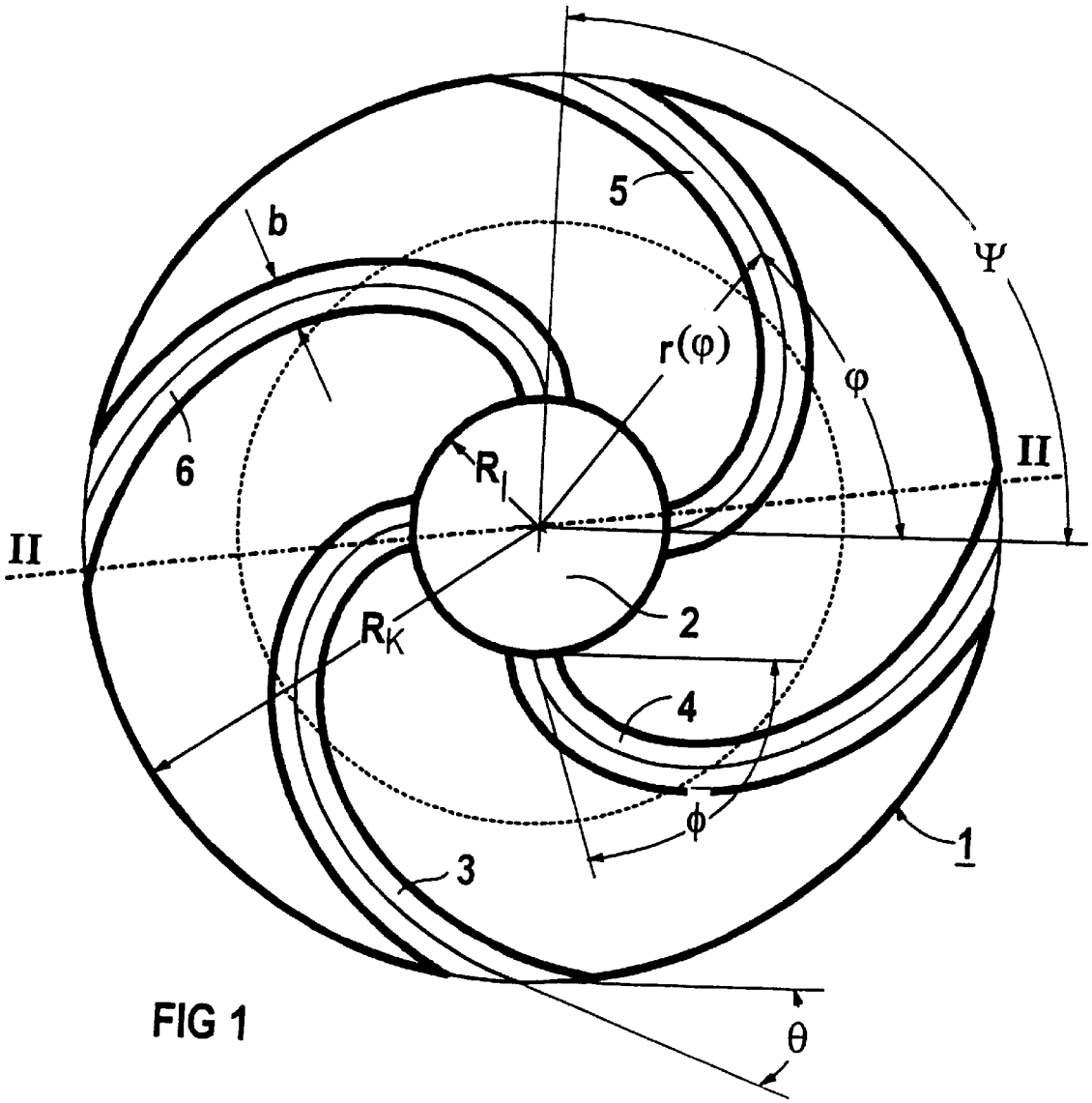
FIG. 1 is a diagrammatic, plan view of a novel spiral contact as part of a contact configuration according to the invention.
Figure 2:
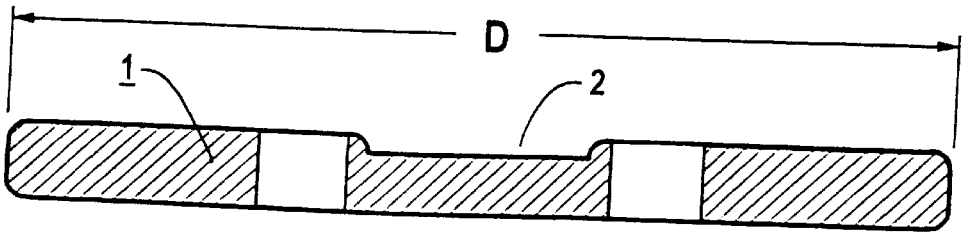
FIG. 2 is a cross-sectional view taken along a line II—II of FIG. 1.
Figure 3A:
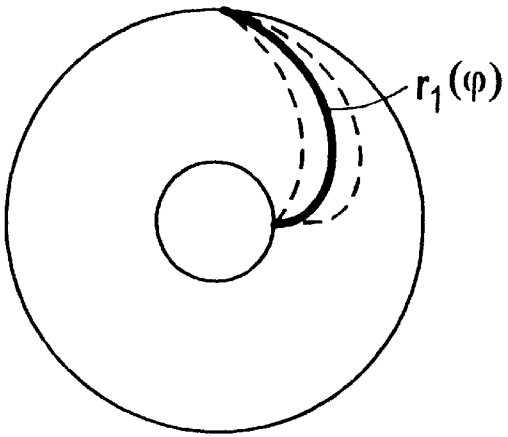
FIGS. 3*a*–3*e* are plan views of various embodiments of a slot contour structure.
Figure 3B:
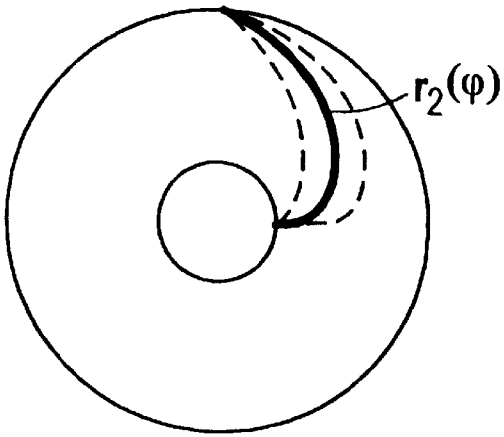
Figure 3C:
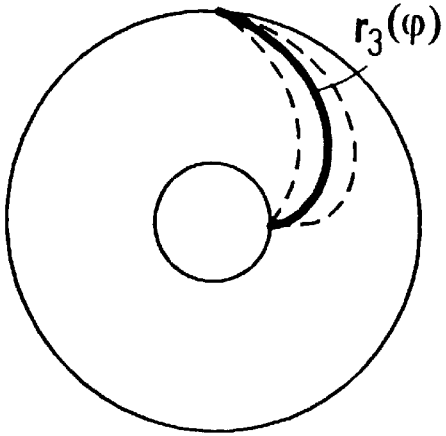
Figure 3D:
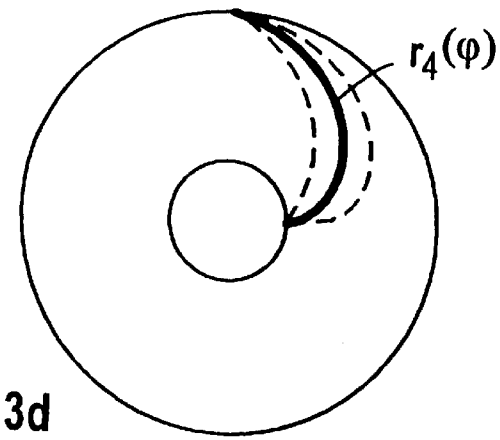
Figure 3E:
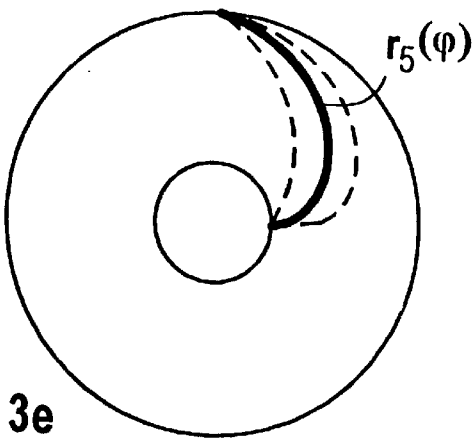

Referring now in detail to the figures of the drawings, which are partially described in common and in which identical and identically acting parts have identical reference symbols, and first, particularly, to FIGS. 1 and 2 thereof, there is seen a switch part or contact piece which is part of a contact configuration for a vacuum switch and, to this end, is disposed in an associated switching tube. The switch part or contact piece 1 is constructed with circular symmetry and has a recess 2 in the center. FIG. 1 shows that four slots 3 to 6 proceed from the recess 2 and extend in each instance in a spiral manner, defining the switch part or contact piece in the form of a spiral contact.

If two such spiral contacts are set opposite one another, a radial magnetic field is created by a current flow. The magnetic field displaces a contracted arc into an azimuthal movement predetermined by the geometry of the spiral contact.

Figure 4:
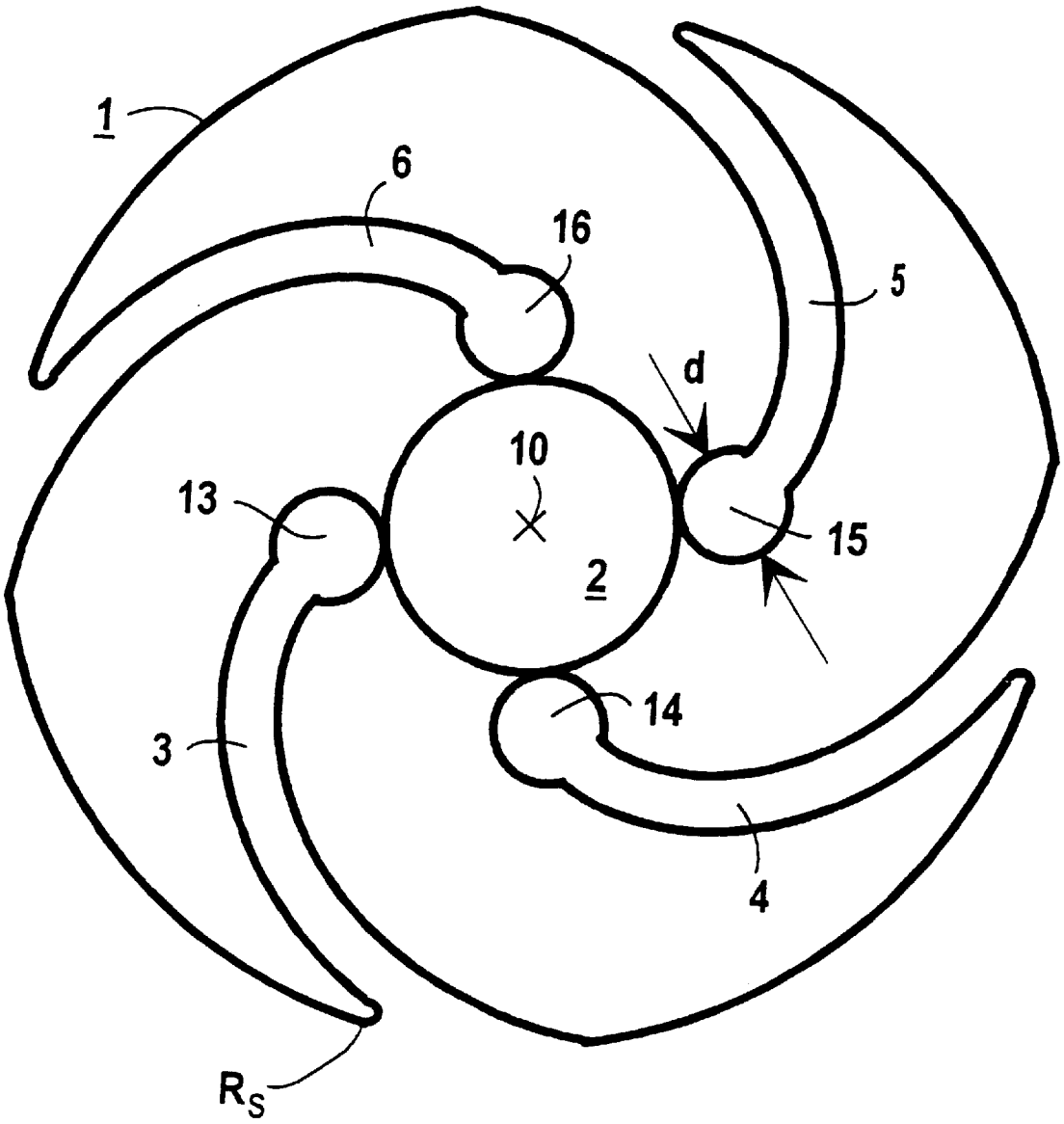
FIG. 4 is a plan view of a spiral contact having four slots which end in front of a recess in circular bores.
Figure 5:
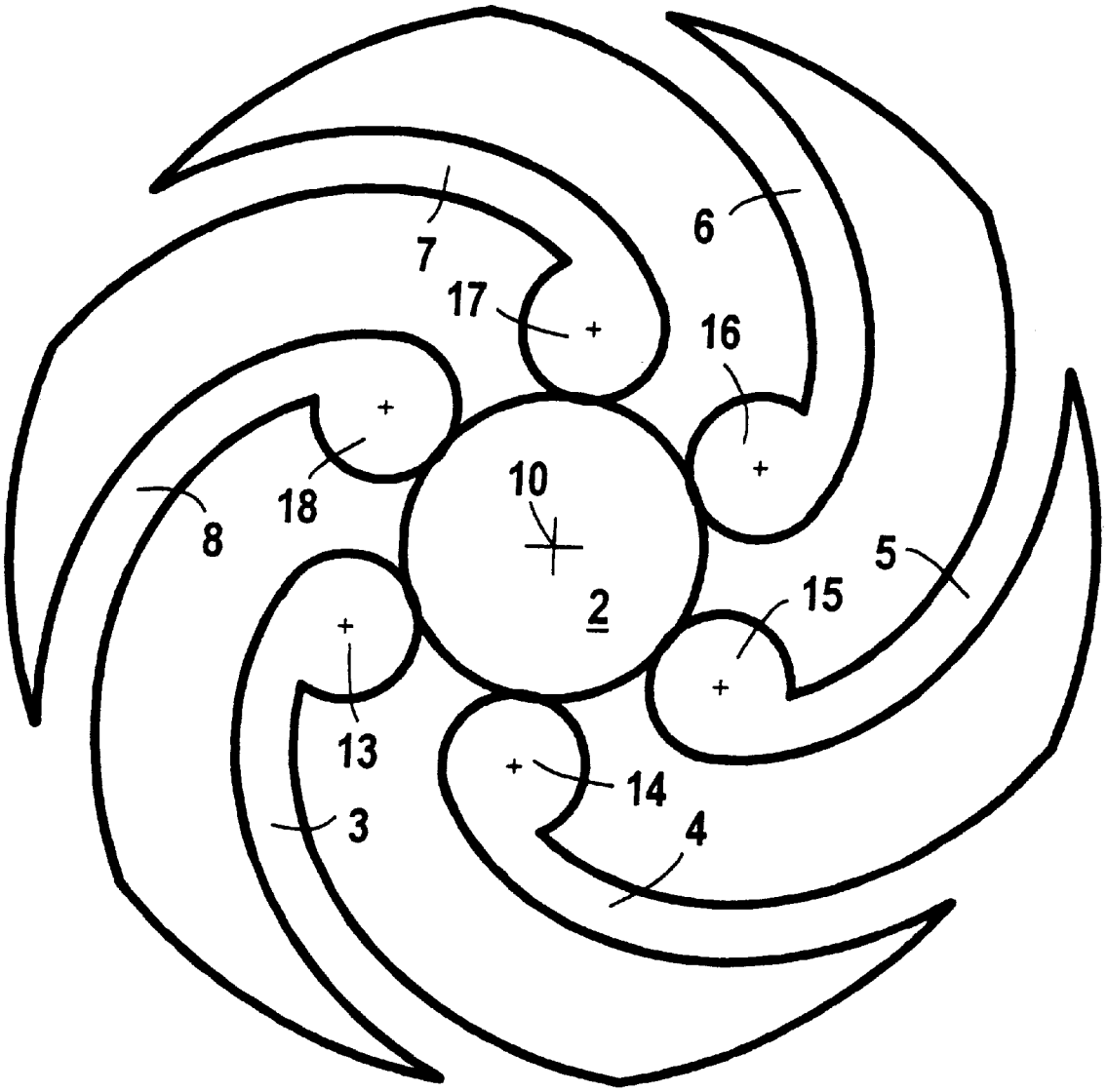
FIG. 5 is a view similar to FIG. 4 of a spiral contact having six slots.

Six slots may equally well be present instead of four slots. For practical purposes, it may be recommended that the slots 3 to 6 or 3 to 8 end in front of the central recess 2 in circular bores 13 to 16 or 13 to 18, as is shown in FIGS. 4 and 5.

The geometric structure of the slots 3 to 6 or 3 to 8 is essential. Such slots have a variable radius $r(\psi)$ with a center that coincides with the contact center, with reference to a polar coordinate system having an origin which coincides with the contact center. The slots 3 to 8 end at the so-called recess 2 which lies at the center of the switch part or contact piece and has a radius $R_I$ or slightly overlap the recess. If $R_K$ is the contact radius, the following applies:

$$R_I \leqq R(\psi) \leqq R_K \text{ and } R_I = 0.25 \ldots 0.33 * R_K \quad (1)$$

The length of the slot, specified in radian measure, is typically:

$$\psi = \frac{5}{12} \ldots \frac{2}{3}\pi \tag{2}$$

The width b of the slot is approximately 4–10% of the contact diameter $D=2*R_K$, i.e.:

$$b=0.04 \ldots 0.01*D \tag{3}$$

A fast free running and commutation of the arc is achieved by slot contours which intersect the recess at the greatest possible angle:

$$\text{possible angle: } \phi > \frac{\pi}{3} \tag{4}$$

and the periphery of the contact at the smallest possible angle:

$$\text{angle: } \theta < \frac{\pi}{6}. \tag{5}$$

Magnetic fields which favorably influence the total phase of the arc movement are obtained, for example, by those slot contours which are analytically described in five cases:

$1^{st}$ Case $$r_1(\psi)=R_I+(R_K-R_I)*$$

$$r_1(\varphi) = R_I + (R_K - R_I)*\left[\frac{\text{Cosh}(a_1 \cdot \varphi) - 1}{\text{Cosh}(a_1 \cdot \psi) - 1}\right]^{f_1} \tag{6.1}$$

where $a_1 = 1$ and $f_1 = 0.30$ $2^{nd}$ Case $$r_2(\psi)=R_I+(R_K-R_I)*$$

$$r_2(\varphi) = R_I + (R_K - R_I)*\left[\frac{\text{Sinh}(a_2 \cdot \varphi)}{\text{Sinh}(a_2 \cdot \psi)}\right]^{f_2} \tag{6.2}$$

where $a_2 = 1$ and $f_2 = 0.50$ $3^{rd}$ Case $$r_3(\psi)=R_I+(R_K-R_I)*$$

$$r_3(\varphi) = R_I + (R_K - R_I)*\left[\frac{1 - \cos(a_3 \cdot \varphi)}{1 - \cos(a_3 \cdot \psi)}\right]^{f_3} \tag{6.3}$$

where $a_3 = 1$, $f_3 = 0.38$ $4^{th}$ Case $$r_4(\psi)=R_I+(R_K-R_I)*$$

$$r_4(\varphi) = R_I + (R_K - R_I)*\left[\frac{\sin(a_4 \cdot \varphi)}{\sin(a_4 \cdot \psi)}\right]^{f_4} \tag{6.4}$$

where $a_4 = 0.5$, $f_4 = 0.75$ $5^{th}$ Case $$r_5(\psi)=R_I+(R_K-R_I)*$$

$$r_5(\varphi) = R_I + (R_K - R_I)*\left[\frac{\varphi}{\psi}\right]^{f_5} \text{ where } f_5 = 0.67 \tag{6.5}$$

The form factors a and f can be varied within specified limits in order to provide a fine coordination of the contour of the slots 3 to 8 with respect to the magnetic field, or for reasons of production engineering. In this case, a reduction of the parameter a even by the factor 100 has only a very small influence on the slot contour in all cases.

In contrast, any increase is restricted in the first two cases to 100 and 50% respectively, and in the remaining cases to 75%, if the slotting of the contact is to be obtainable in practice.

Within the context of a meaningful structure of the contacts, the alteration of the parameter f upward and downward is restricted to the factor 2.

FIGS. 3*a*–3*e* show the slot contours which arise in the specified five cases, together with the limits within which they can change in the case of the specified variations of a and f. Other mathematical descriptions of the slot contours specified herein or of ones which deviate only slightly therefrom are also possible in an entirely corresponding manner. This is possible, for example, through the use of series expansions or linear combinations of the relations specified herein, as well as linkage of the expressions appearing in square brackets in Cases 1 to 5 in accordance with:

$$r(\varphi) = R_I + (R_K - R_I)\cdot \left[\gamma_1 \frac{\text{Cosh}(a_1\varphi) - 1}{\text{Cosh}(a_1\psi) - 1} + \gamma_2 \frac{\text{Sinh}(a_2\varphi)}{\text{Sinh}(a_2\psi)} + \gamma_3 \frac{1 - \cos(a_3\varphi)}{1 - \cos(a_3\psi)} + \left(\gamma_4 \frac{\sin(a_4\varphi)}{\sin(a_4\psi)} + \gamma_5\left(\frac{\varphi}{\psi}\right)\right]\right)^f$$

where $$\sum_v \gamma_v = 1$$

and $0.01<a_i<1$ as well as $0.2<f<0.75$ (6.6)

A common feature in this case includes the properties in accordance with expressions 6.1–6.5 and the fact that the foot of the radius of the slot contour coincides with the center of the contact.

Difficulties may arise for reasons of machine technology in the course of the milling of the contact slots 3 to 8 in the vicinity of the recess, because of the small radius of curvature which exists in this case. Therefore, according to FIG. 4 the slot can be replaced, in this region, by a bore 13 to 18 having a diameter d. The bores 13 to 18 should either contact or slightly overlap the recess. The diameter is usefully limited upward in accordance with:

$$d \leqq 3*b. \tag{7}$$

The distance e of the center of this bore from the slot contour is within the range:

$$0 \le e \le \frac{d-b}{2}. \tag{8}$$

FIG. 5 shows an example of bores having centers which do not lie on the slot contour.

It is possible to replace sharp edges which are represented in FIG. 4, at wing-slot or bore-slot transitions, as well as wing tips, by roundings having a radius of curvature:

$$R_s = 0.25 \ldots 1.0 * b \tag{9}$$

if the probability of re-ignition has to be reduced.

I claim:

1. A contact configuration for vacuum switches, comprising:

a pair of confronting contact pieces having a circular base with radius $R_K$, each contact piece having a center, an outer perimeter and a central circular recess defining an inner perimeter of said contact piece;

each of said contact pieces having three to six individual slots extending from said inner perimeter of said contact piece to said outer perimeter of said contact piece, forming a spiral-type contact;

said slots having contours with a variable and increasing radius of curvature and being described by a radius r depending on an angle ψ in a polar coordinate system with an origin coinciding with said center of said contact pieces;

said slots having a length in radian measure between 5/12 and 2/3 π in relation to the outer perimeter of said contact piece, each of said individual slots forming an angle $\psi > \pi/3$ with the inner perimeter of said contact piece.

2. The contact configuration according to claim 1, wherein said slots end at said recess wherein $R_I = (0.25 \ldots 0.33)\, R_K$, where $R_K$ is a predetermined radius of said contact piece and $R_I$ is a predetermined radius of said recess defining said inner perimeter of said contact piece.

3. The contact configuration according to claim 2, wherein said slots end in circular bores in front of said recess defining said inner perimeter of said contact piece.

4. The contact configuration according to claim 1, wherein $R_I \leqq r(\psi) \leqq R_K$, where $r(\psi)$ is said radius of said slot contours in a polar coordinate system, $R_K$ is said predetermined radius of said (switch parts) contact piece and $R_1$ is said predetermined radius of said recess defining the inner perimeter of said contact piece.

5. The contact configuration according to claim 4, wherein said slot contour is described by the following relation:

$$r(\psi) = R_I + (R_K - R_I) *$$

$$r(\varphi) = R_I + (R_K - R_I) * \left[\frac{\mathrm{Cosh}(a_1 \cdot \varphi) - 1}{\mathrm{Cosh}(a_1 \cdot \psi) - 1}\right]^{f_1}$$

where $0.01 < a_1 < 2$ and $0.15 < f_1 < 0.6$, with $a_1$ being a shape factor, $f_1$ being an exponent for influencing said slot contour, $R_K$ being the radius of said outer perimeter and $R_I$ being the radius of said inner perimeter of said contact piece.

6. The contact configuration according to claim 5, wherein $a_1 = 1$ and $f_1 = 0.30$.

7. The contact configuration according to claim 4, wherein said slot contour is described by the following relation:

$$r(\psi) = R_1 + (R_K - R_1) *$$

$$r(\varphi) = R_I + (R_K - R_I) * \left[\frac{\mathrm{Sinh}(a_2 \cdot \varphi)}{\mathrm{Sinh}(a_2 \cdot \psi)}\right]^{f_2}$$

where $0.01 < a_2 < 1.5$ and $0/25 < f_2 < 1$, with $a_2$ being a shape factor, $f_1$ being an exponent for influencing said slot contour, $R_K$ being the radius of said outer perimeter and $R_I$ being the radius of said inner perimeter of said contact piece.

8. The contact configuration according to claim 7, wherein $a_2 = 1$ and $f_2 = 0.50$.

9. The contact configuration according to claim 4, wherein said slot contour is described by the following relation:

$$r(\psi) = R_I + (R_K - R_I) *$$

$$r(\varphi) = R_I + (R_K - R_I) * \left[\frac{1 - \cos(a_3 \cdot \varphi)}{1 - \cos(a_3 \cdot \psi)}\right]^{f_3}$$

where $0.01 < a_3 < 1.75$ and $0.19 < f_3 < 0.76$, with $a_3$ being a shape factor, $f_3$ being an exponent for influencing said slot contour, $R_K$ being the radius of said outer perimeter and $R_I$ being the radius of said inner perimeter of said contact piece.

10. The contact configuration according to claim 9, wherein $a_3 = 1$ and $f_3 = 0.38$.

11. The contact configuration according to claim 4, wherein said slot contour is described by the following relation:

$$r(\psi) = R_I + (R_K - R_I) *$$

$$r(\varphi) = R_I + (R_K - R_I) * \left[\frac{\sin(a_4 \cdot \varphi)}{\sin(a_4 \cdot \psi)}\right]^{f_4}$$

and $0.01 < a_4 < a_4 < 0.88$ and $0.37 < f_4 < 1.5$, with $a_2$ being a shape factor, $f_4$ being an exponent for influencing said slot contour, $R_K$ being the radius of said outer perimeter and $R_I$ being the radius of said inner perimeter of said contact piece.

12. The contact configuration according to claim 11, wherein $a_4 = 0.5$ and $f_4 = 0.75$.

13. The contact configuration according to claim 4, wherein said slot contour is described by the following relation:

$$r(\psi) = R_I + (R_K - R_I) *$$

$$r(\varphi) = R_I + (R_K - R_I) * \left[\frac{\varphi}{\psi}\right]^{f_5}$$

where $0.34 < f_5 < 1.35$, with $a_5$ being a shape factor, $f_5$ being an exponent for influencing said slot contour, $R_K$ being the radius of said outer perimeter and $R_I$ being the radius of said inner perimeter of said contact piece.

14. The contact configuration according to claim 13, wherein $f_5 = 0.67$.

15. The contact configuration according to claim 5, including at least one of linear combinations and series expansions of said relation.

16. The contact configuration according to claim 7, including at least one of linear combinations and series expansions of said relation.

17. The contact configuration according to claim 9, including at least one of linear combinations and series expansions of said relation.

18. The contact configuration according to claim 11, including at least one of linear combinations and series expansions of said relation.

19. The contact configuration according to claim 13, including at least one of linear combinations and series expansions of said relation.

20. The contact configuration according to claim 4, wherein said slot contour is described by the following relation:

$$r(\varphi) = R_I + (R_K - R_I)\cdot \left[\gamma_1 \frac{\mathrm{Cosh}(a_1\varphi) - 1}{\mathrm{Cosh}(a_1\psi) - 1} + \gamma_2 \frac{\mathrm{Sinh}(a_2\varphi)}{\mathrm{Sinh}(a_2\psi)} + \right.$$

-continued $$\left. \gamma_3 \frac{1 - \cos(a_3\varphi)}{1 - \cos(a_3\psi)} + \gamma_4 \frac{\sin(a_4\varphi)}{\sin(a_4\psi)} + \gamma_5 \left(\frac{\varphi}{\psi}\right)\right]^f$$

where $$\sum_v \gamma_v = 1$$

and 0.01<a<1 as well as 0.2<f<0.75, with $a_i$ being shape factors where i=1, 2, 3, 4, f being an exponent for influencing said slot contour, $R_K$ being the radius of said outer perimeter and $R_I$ being the radius of said inner perimeter of said contact piece.

21. The contact configuration according to claim 1, wherein said slots have a diameter D and a width b smaller than 1/10 of the diameter D=2 $R_K$ of said contact piece.

22. The contact configuration according to claim 21, wherein 0.04 D≦b≦0.1 D with 2 $R_K$=D.

* * * * *